US010876246B2

(12) United States Patent
Beckley

(10) Patent No.: US 10,876,246 B2
(45) Date of Patent: Dec. 29, 2020

(54) LEVEL SENSOR FOR A BULK DISPENSE TANK IN A WASHING MACHINE APPLIANCE

(71) Applicant: Haier US Appliance Solutions, Inc., Wilmington, DE (US)

(72) Inventor: Bryan James Beckley, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/133,994

(22) Filed: Sep. 18, 2018

(65) Prior Publication Data

US 2020/0087836 A1 Mar. 19, 2020

(51) Int. Cl.

| | |
|---|---|
| ***D06F 39/02*** | (2006.01) |
| ***D06F 37/20*** | (2006.01) |
| ***D06F 33/00*** | (2020.01) |

(52) U.S. Cl.

CPC ..... *D06F 39/022* (2013.01); *D06F 33/00* (2013.01); *D06F 37/203* (2013.01); *D06F 2202/085* (2013.01); *D06F 2204/10* (2013.01); *D06F 2222/00* (2013.01)

(58) Field of Classification Search

CPC .. D06F 39/087; D06F 37/203; D06F 2103/18; D06F 2202/085; D06F 33/48; D06F 33/76; D06F 34/16; D06F 2222/00; G01F 23/32; G01F 23/38

See application file for complete search history.

(56) References Cited

U.S. PATENT DOCUMENTS

| | | | | |
|---|---|---|---|---|
| 9,328,451 | B2 | 5/2016 | Kappler et al. | |
| 2015/0368849 | A1* | 12/2015 | Pessot | D06F 39/087 68/17 R |
| 2016/0097149 | A1* | 4/2016 | Goshgarian | D06F 39/028 8/137 |
| 2017/0342635 | A1 | 11/2017 | Song et al. | |
| 2018/0004233 | A1 | 1/2018 | Lin et al. | |
| 2018/0330315 | A1* | 11/2018 | Gurumohan | H04W 76/14 |
| 2018/0355542 | A1* | 12/2018 | Jiang | D06F 39/088 |

FOREIGN PATENT DOCUMENTS

| | | | |
|---|---|---|---|
| CN | 204613767 | U * | 9/2015 |
| EP | 1087052 | A2 | 3/2001 |

OTHER PUBLICATIONS

CN204613767—Machine Translation (Year: 2015).*

* cited by examiner

*Primary Examiner* — Marc Lorenzi
(74) *Attorney, Agent, or Firm* — Dority & Manning, P.A.

(57) ABSTRACT

A washing machine appliance includes a level sensor positioned within a bulk dispense tank. The level sensor includes a tether, a float body and a circuit board. The tether is mounted within the bulk dispense tank such that a distal end portion of the tether is moveable relative to the bulk dispense tank. The float body is positioned at the distal end portion of the tether. The circuit board is positioned within the float body and has one or more of an accelerometer chip and a gyroscope chip.

7 Claims, 5 Drawing Sheets

LEVEL SENSOR FOR A BULK DISPENSE TANK IN A WASHING MACHINE APPLIANCE

FIELD OF THE INVENTION

The present subject matter relates generally to washing machine appliances with bulk dispense tanks.

BACKGROUND OF THE INVENTION

Washing machine appliances can use a variety of fluid additives (in addition to water) to assist with washing and rinsing a load of articles. For example, detergents and/or stain removers may be added during wash and prewash cycles of washing machine appliances. As another example, fabric softeners may be added during rinse cycles of washing machine appliances.

Fluid additives are preferably introduced at an appropriate time during the operation of washing machine appliance and in a proper volume. By way of example, adding insufficient volumes of either the detergent or the fabric softener to the laundry load can negatively affect washing machine appliance operations by diminishing efficacy of a cleaning operation. Similarly, adding excessive volumes of either the detergent or the fabric softener can also negatively affect washing machine appliance operations by diminishing efficacy of a cleaning operation.

As a convenience to the consumer, certain washing machine appliances include systems for automatically dispensing detergent and/or fabric softener. Such systems can store one or more fluid additives in bulk and dispense such fluid additives during operation of the washing machine appliances. However, accurately measuring a remaining level of fluid additive can be difficult. In particular, known sensors interact with detergents and fabric softeners in a problematic manner.

For instance, detergent and fabric softener creates a film over optical sensors that causes false readings. Similarly, a film of detergent or fabric softener can bridge probes of conductivity sensors, and such sensors are susceptible to electrical noise. With traditional float sensors, the float can clog with detergent and fabric softener such that the float is immobile. Further, capacitive sensors require a precise wall thickness to measure the level of detergent and fabric softener within a tank, and tank wall thickness is difficult to control.

BRIEF DESCRIPTION OF THE INVENTION

Aspects and advantages of the invention will be set forth in part in the following description, or may be apparent from the description, or may be learned through practice of the invention.

In a first example embodiment, a washing machine appliance includes a cabinet. A tub is positioned within the cabinet, and a basket is positioned within the tub. The basket is rotatable within the tub. A bulk dispense tank is positioned within the cabinet. The bulk dispense tank is configured such that fluid additive within the bulk dispense tank is flowable to the tub. The bulk dispense tank is sized to hold a volume of the fluid additive for a plurality of wash cycles. A level sensor is positioned within the bulk dispense tank. The level sensor includes a tether, a float body and a circuit board. The tether is mounted within the bulk dispense tank such that a distal end portion of the tether is movable relative to the bulk dispense tank. The float body is positioned at the distal end portion of the tether. The circuit board is positioned within the float body and has one or more of an accelerometer chip and a gyroscope chip.

In a second example embodiment, a washing machine appliance includes a cabinet. A tub is positioned within the cabinet. A basket is positioned within the tub. A motor is coupled to the basket. The motor is operable to rotate the basket within the tub. A bulk dispense tank is positioned within the cabinet. The bulk dispense tank is configured such that fluid additive within the bulk dispense tank is flowable to the tub. The bulk dispense tank sized to hold a volume of the fluid additive for a plurality of wash cycles. A level sensor is positioned within the bulk dispense tank. The level sensor includes a tether, a float body and a circuit board. The tether is mounted within the bulk dispense tank such that a distal end portion of the tether is movable relative to the bulk dispense tank. The float body is positioned at the distal end portion of the tether. The circuit board is positioned within the float body. The circuit board includes a gyroscope chip configured to measure movement of the float body on the tether.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
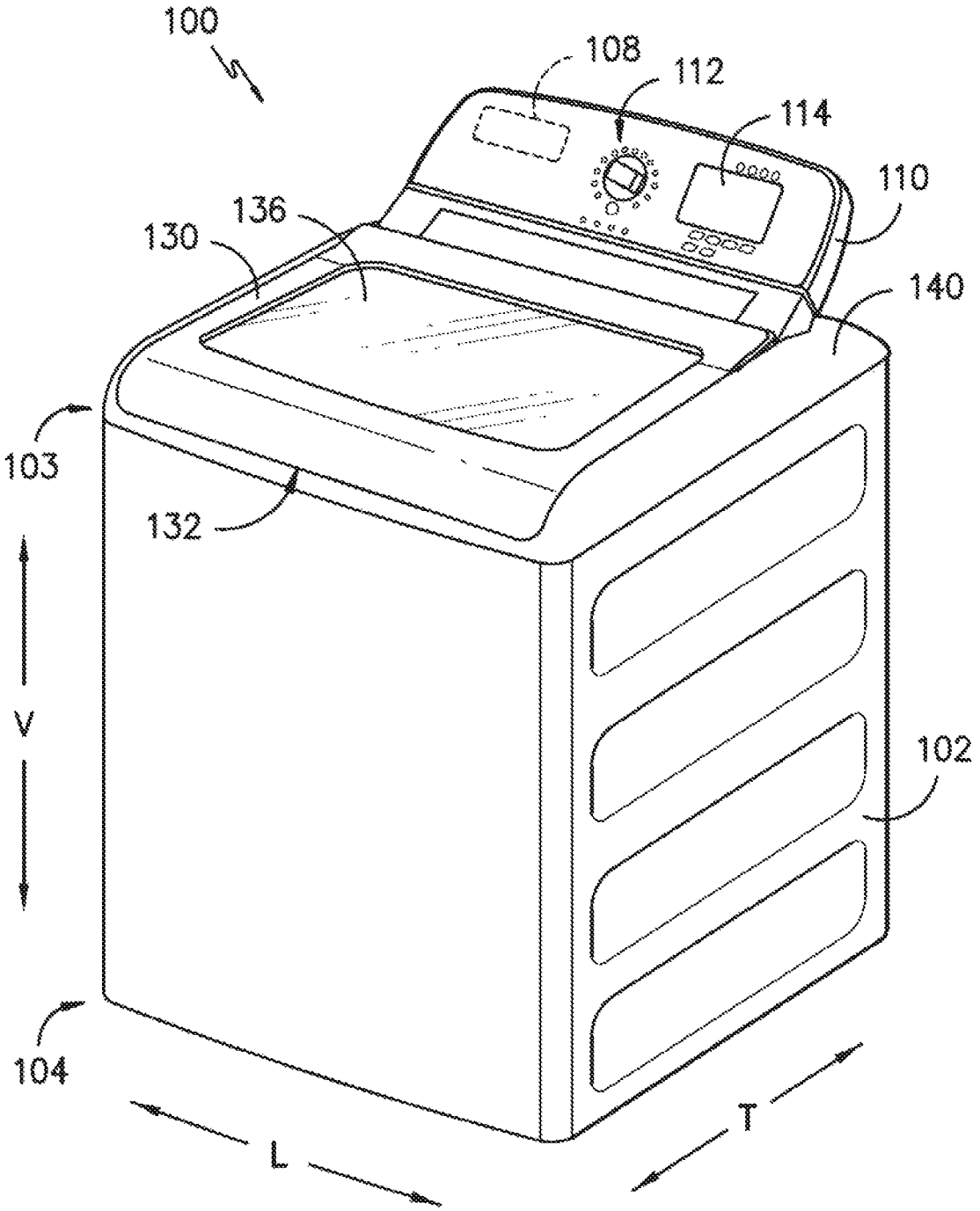
FIG. 1 provides a perspective view of a washing machine appliance according to an example embodiment of the present subject matter with a door of the example washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
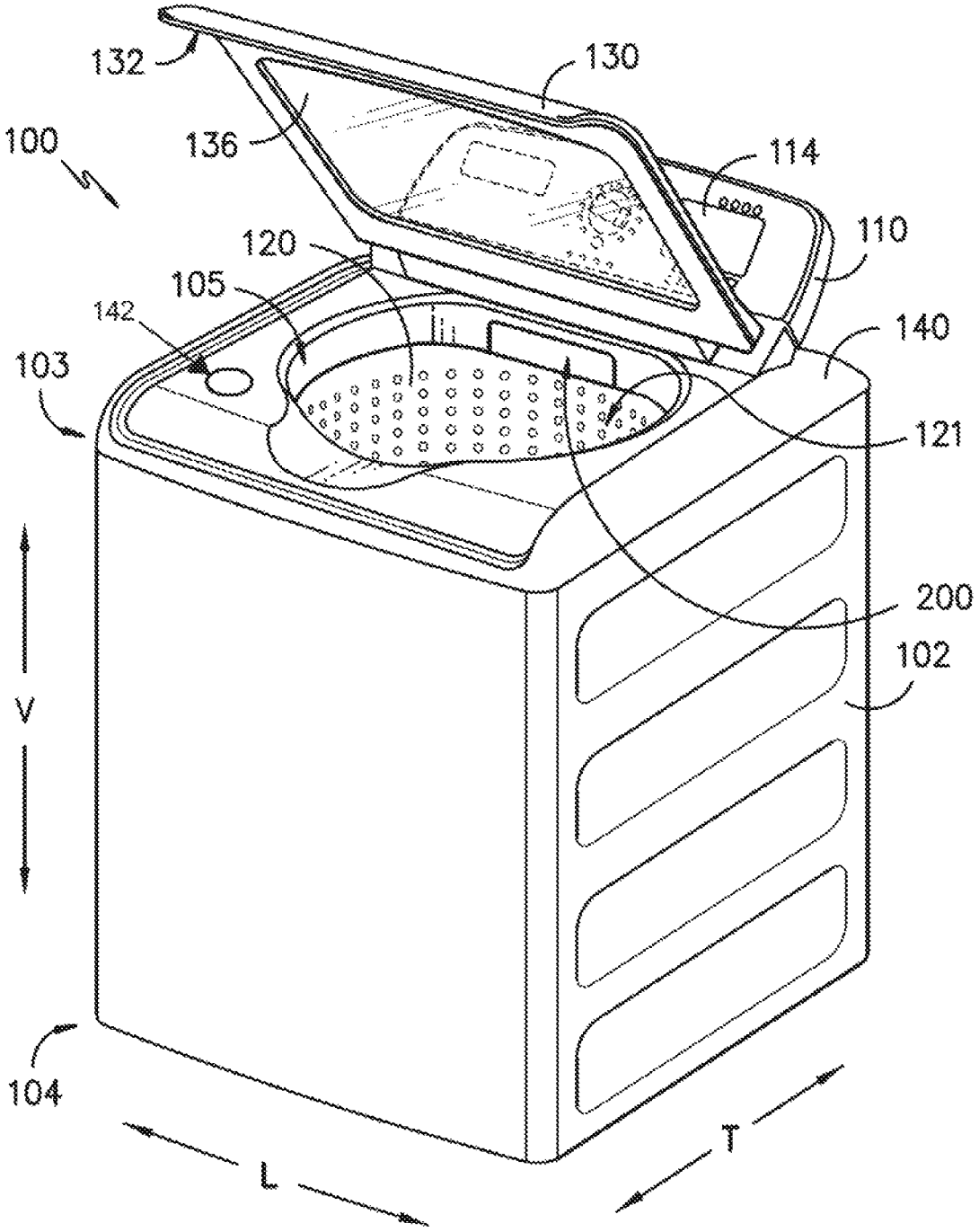
FIG. 2 provides a perspective view of the example washing machine appliance of FIG. 1 with the door of the example washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, which are mutually perpendicular with one another, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash tub 118 (FIG. 6) is disposed within cabinet 102, and a wash basket 120 is rotatably mounted within tub 118. A motor (not shown) is in mechanical communication with wash basket 120 to selectively rotate wash basket 120 (e.g., during an agitation or a rinse cycle of washing machine appliance 100). Wash basket 120 defines a wash chamber 121 that is configured for receipt of articles for washing. Tub 118 holds wash and rinse fluids for agitation in wash basket 120 within tub 118. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140, e.g., at top portion 103 of cabinet 102. Top panel 140 defines an aperture 105 that permits user access to wash basket 120 of tub 118. Door 130, rotatably mounted to top panel 140, permits selective access to aperture 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

Top panel 140 also defines a hole or opening 142, e.g., at a corner of top panel 140 at or adjacent a front portion of top panel 140 as shown in FIG. 2. Opening 142 is configured for receipt of one of a plurality of fluid additives, e.g., detergent, fabric softener, and/or bleach. Opening 142 permits the fluid additive to pass through top panel 140 to a reservoir 260 (FIG. 6) disposed below top panel 140 along the vertical direction V. Thus, a user may pour the fluid additive into reservoir 260 through opening 142 in top panel 140. Reservoir 260 is described in greater detail below.

A control panel 110 with at least one input selector 112 extends from top panel 140, e.g., at a rear portion of cabinet 102 opposite opening 142 about aperture 105 along the transverse direction T. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through aperture 105, and washing operation is initiated through operator manipulation of input selectors 112. Tub 118 is filled with water and detergent and/or other fluid additives via dispenser box assembly 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through aperture 105.

Dispenser box assembly 200 may be mounted underneath top panel 140 of cabinet 102, e.g., at a rear portion of cabinet 102, such that a front side of dispenser box assembly 200 is accessible at aperture 105 of top panel 140. One skilled in the art will appreciate that dispenser box assembly 200 may be mounted in other locations in alternative example embodiments. For example, a bulk delivery system may be positioned external to cabinet 102, such as in a pedestal below washing machine appliance 100.

Figure 3:
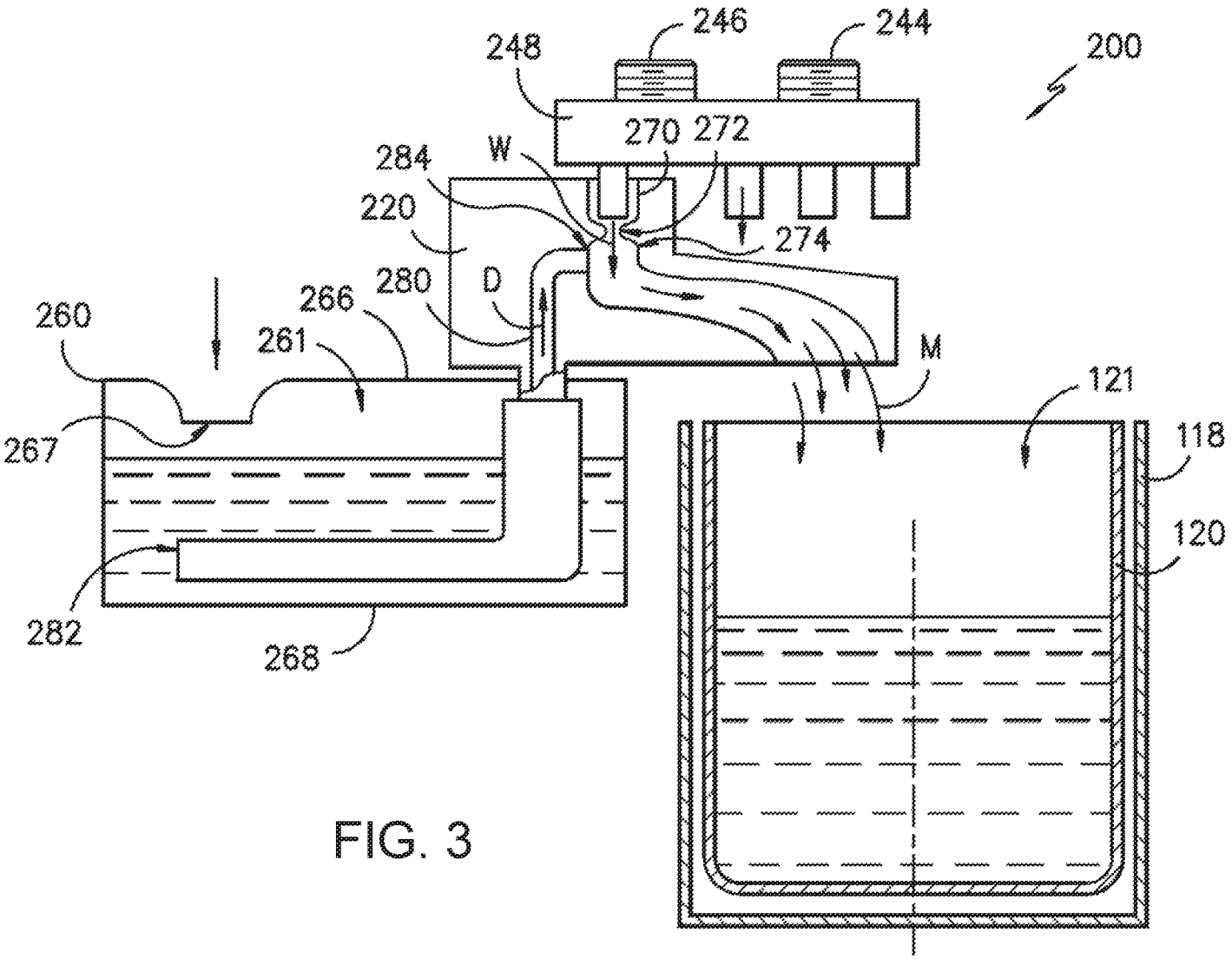
FIG. 3 provides a schematic view of certain components of the example washing machine appliance of FIG. 1.
Figure 4:
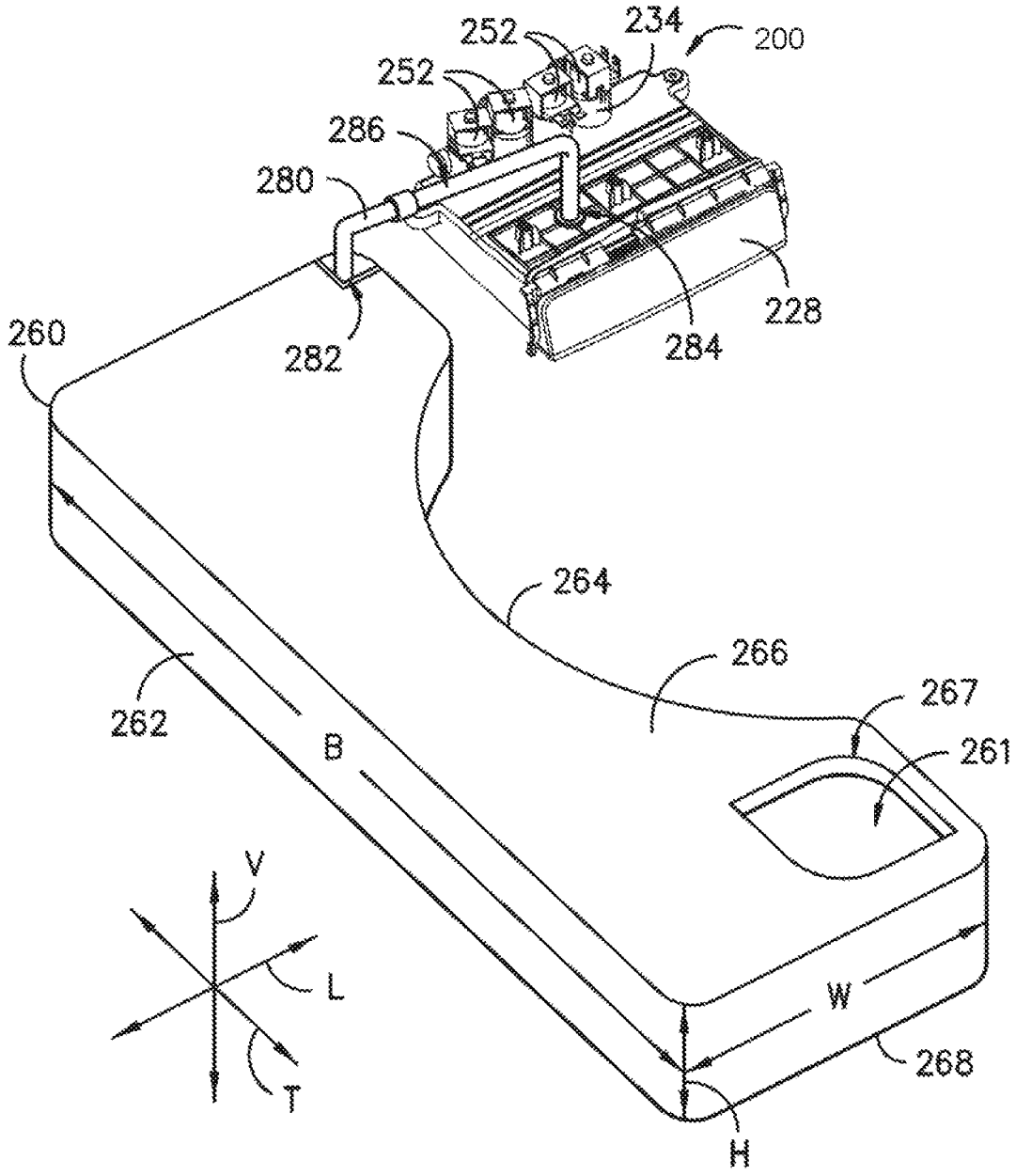
FIG. 4 provides a perspective view of a reservoir of the example washing machine appliance of FIG. 1.

Turning to FIGS. 3 and 4, dispenser box assembly 200 may define a mixing chamber 220 configured to receive one or more fluid additive compartments. For example, according to the illustrated embodiment, mixing chamber 220 may include a detergent compartment and a softener compartment. A user may pull on front panel 228 to slide the detergent and softener compartments along the transverse direction T. Once extended, the detergent compartment and the softener compartment may be conveniently filled with detergent and softener, respectively. Front panel 228 may be then be pushed back into mixing chamber 220, e.g., before a wash cycle begins.

A hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection. Notably, hot water inlet 244 is in direct fluid communication with first valve seat 234. However, because washing machine appliance 100 uses cold water for multiple purposes, cold water inlet 246 is in fluid communication with a cold water manifold 248.

Dispenser box assembly 200 may also include a plurality of valves configured to supply hot and cold water to mixing chamber 220 or directly to tub 118. For example, dispenser box assembly 200 may include a plurality of water valves 252 with each of the water valves 252 mounted to a respective valve seat that is in fluid communication with mixing chamber 220. As an example, a first valve seat 234 may be in fluid communication mixing chamber 220 (e.g., the detergent compartment of mixing chamber 220), and the water valve 252 on first valve seat 234 may regulate a flow of hot water or cold water into mixing chamber 220. Thus, e.g., each of the valve seats may be configured to receive one of water valves 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through and/or from cold water manifold 248 into mixing chamber 220.

Dispenser box assembly 200 may also include one or more outlets (not shown) for directing wash fluid, such as water and/or a mixture of water and at least one fluid additive, e.g., detergent, fabric softener, and/or bleach into tub 118 from dispenser box assembly 200. Water may mix with detergent placed in the detergent compartment to create wash liquid to be dispensed into tub 118. An outlet (not shown) may be positioned on the bottom of mixing chamber 220 to dispense the wash fluid into tub 118. According to the illustrated embodiment, dispenser box assembly 200 may include four outlets; each associated with a respective one of valves seats. As an example, outlets may be positioned on a bottom of mixing chamber 220 near tub 118 or directly on tub 118.

As shown in FIGS. 3 and 4, a reservoir 260 of washing machine appliance 100 may be fluidly coupled to dispenser box assembly 200. Although described in greater detail below in the context of washing machine appliance 100 and dispenser box assembly 200, it will be understood that reservoir 260 may be used in or with any other suitable washing machine appliance and/or without dispenser box assembly 200, in alternative exemplary embodiments. In addition, other configurations of reservoir 260 may be provided as well. For example, reservoir 260 may be positioned on a front of cabinet 102, may have a different shape or chamber configuration. Other variations and modifications of the exemplary embodiment described below are possible, and such variations are contemplated as within the scope of the present subject matter.

Reservoir 260 may be filled with detergent, and washing machine appliance 100 includes features for drawing detergent within reservoir 260 to dispenser box assembly 200. Within dispenser box assembly 200, the detergent from reservoir 260 is mixed with water and directed into tub 118 of washing machine appliance 100. Thus, reservoir 260 may contain a bulk volume of detergent (e.g., or other suitable fluid additive) such that reservoir 260 is sized for holding a volume of detergent sufficient for a plurality of wash cycles of washing machine appliance 100, such as no less than twenty wash cycles, no less than fifty wash cycles, etc. As a particular example, an internal volume 261 of reservoir 260 is configured for containing detergent therein, and the internal volume 261 of reservoir 260 may be no less than twenty fluid ounces, no less than three-quarters of a gallon or about one gallon. As used herein the term "about" means within half a gallon of the stated volume when used in the context of volumes. Thus, a user can avoid filling dispenser box assembly 200 with detergent before each operation of washing machine appliance by filling reservoir 260 with detergent.

As discussed above, reservoir 260 is positioned below top panel 140 (FIG. 2). In particular, an inlet 267 of reservoir 260 may be positioned at (e.g., directly below) opening 142 of top panel 140. Thus, a user may pour detergent into reservoir 260 via opening 142 of top panel 140 in order to load or fill reservoir 260 with detergent.

Reservoir 260 includes a planar sidewall 262, an arcuate sidewall 264, a top wall 266 and a bottom wall 268. Planar sidewall 262 and arcuate sidewall 264 or reservoir 260 are spaced apart from each other, e.g., along the lateral direction L. Top wall 266 and a bottom wall 268 of reservoir 260 are also spaced apart from each other, e.g., along the vertical direction V. Planar sidewall 262 and arcuate sidewall 264 of reservoir 260 may extend along the vertical direction V between top wall 266 and a bottom wall 268 of reservoir 260 in order to connect top wall 266 of reservoir 260 to bottom wall 268 of reservoir 260. Reservoir 260 may also include end walls (not labeled) that are spaced apart from each other, e.g., along the transverse direction T, and that extend along the vertical direction V between top wall 266 and bottom wall 268 of reservoir 260 in order to connect top wall 266 of reservoir 260 to bottom wall 268 of reservoir 260. Reservoir 260 may be formed from any suitable material, such as molded plastic.

Reservoir 260 has a height H along the vertical direction V. The height H of reservoir 260 may be defined between top wall 266 and bottom wall 268 of reservoir 260. Reservoir 260 also has a width W along the lateral direction L. The width W of reservoir 260 may be defined between planar sidewall 262 and arcuate sidewall 264 of reservoir 260 (e.g., at the portion of reservoir 260 where planar sidewall 262 and arcuate sidewall 264 of reservoir 260 are most spaced apart from each other along the lateral direction L). Reservoir 260 further has a breadth B along the transverse direction T. The breadth B of reservoir 260 may be defined between the opposing end walls of reservoir 260.

Reservoir 260 may be sized such that reservoir 260 is shorter along the vertical direction V than along the transverse direction T and/or the lateral direction L. For example, the height H of reservoir 260 may be no greater than six inches or no greater than four inches. As another example, the height H of reservoir 260 may be about four inches. As used herein, the term "about" means within half an inch of the stated height when used in the context of heights. Thus, reservoir 260 may have a small profile along the vertical direction V under top panel 140.

In contrast to the low vertical profile of reservoir 260, the width W and/or breadth B of reservoir 260 may be larger than the height H of reservoir 260. For example, the width W of reservoir 260 may be less than twelve inches and greater than six inches or less than ten inches and greater than seven inches. As another example, the width W of reservoir 260 may be about eight inches. As used herein, the term "about" means within an inch of the stated width when used in the context of widths. With respect to the breadth B of reservoir 260, as an example, the breadth B of reservoir 260 may be less than twenty-eight inches and greater than sixteen inches or less than twenty-four inches and greater than eighteen inches. As another example, the breadth B of reservoir 260 may be about twenty-four inches. As used herein, the term "about" means within three inches of the stated breadth when used in the context of breadths. Thus, reservoir 260 may have a small profile along the vertical direction V under top panel 140 while still being sized to contain a significant volume of detergent, e.g., no less than three-quarters of a gallon of detergent.

Washing machine appliance 100 includes various features for drawing detergent from reservoir 260 and directing the detergent into tub 118. For example, washing machine appliance 100 includes a Venturi pump 270 and a supply conduit 280. Supply conduit 280 extends between reservoir 260 and Venturi pump 270, and Venturi pump 270 draws detergent from reservoir 260 when a valve associated with Venturi pump 270 is open and water flows through Venturi pump 270. As an example, Venturi pump 270 may be configured to receive a flow of water F when one valve seat position of water valve 252 is opened (e.g., the water valve 252 on second valve seat 236). Thus, when one valve seat position of water valve 252 is open, the flow of water F may pass through Venturi pump 270.

As may be seen in FIG. 3, Venturi pump 270 may be disposed on or formed with dispenser box assembly 200. In alternative exemplary embodiments, Venturi pump 270 may be disposed on or formed with any other suitable component of washing machine appliance 100. Venturi pump 270 includes a converging section 272 and a diverging section 274. Converging section 272 of Venturi pump 270 is disposed upstream of diverging section 274 of Venturi pump 270 relative to the flow of water F through Venturi pump 270. As the flow of water F enters converging section 272 of Venturi pump 270, the flow of water F may increase in velocity and decrease in pressure. Conversely, as the flow of water passes from converging section 272 of Venturi pump 270 into diverging section 274 of Venturi pump 270, the flow of water F may increase in pressure and decrease in velocity.

Supply conduit 280 extends between an inlet 282 and an outlet 284, e.g., along the lateral direction L. Inlet 282 of supply conduit 280 is disposed within reservoir 260, e.g., at or adjacent bottom wall 268 of reservoir 260. Outlet 284 of supply conduit 280 is disposed at Venturi pump 270. A flow of detergent D may enter supply conduit 280 at inlet 282 of supply conduit 280, flow through supply conduit 280 to Venturi pump 270 and enter Venturi pump 270 via outlet 284 of supply conduit 280.

The change in pressure for the flow of water F through Venturi pump 270 may assist with drawing detergent from reservoir 260. For example, internal volume 161 of reservoir 260 may be exposed to or contiguous with ambient air about washing machine appliance 100 (e.g., via inlet 267 of reservoir 260), and outlet 284 of supply conduit 280 may be positioned on Venturi pump 270 (e.g., converging section 272 of Venturi pump 270 or diverging section 274 of Venturi pump 270) such that a pressure of fluid at outlet 284 of supply conduit 280 is less than the pressure of detergent within reservoir 260 at inlet 282 of supply conduit 280. Thus, Venturi pump 270 may pump the flow of detergent D from reservoir 260 to Venturi pump 270 via supply conduit 280 when the flow of water F passes through Venturi pump 270. Within Venturi pump 270, the flow of water F and the flow of detergent D mix and a mixture of water and detergent M exits Venturi pump 270 and flows into tub 118. In such a manner, detergent from reservoir 260 may be dispensed in to tub 118.

The shape, construction and location of reservoir 260 can assist with providing a very cost-effective bulk dispense system that delivers accurate fluid additive dosing, e.g., without the use of a costly pressure sensor. When Venturi pump 270 is actuated for a predetermined amount of time, the amount of fluid additive dispensed from reservoir 260 to Venturi pump 270 is essentially constant, e.g., because the priming time of Venturi pump 270 is also essentially constant, within a small but acceptable error, whatever the fill level of fluid additive within reservoir 260. For example, the priming time of Venturi pump 270 when reservoir 260 is full will be about equal to the priming time of Venturi pump 270 when reservoir 260 is almost empty due to the low vertical profile of reservoir 260. In particular, the level of fluid additive within reservoir 260 can vary by less than six inches between full and empty such that the priming time of Venturi pump 270 is similar in both circumstances.

As may be seen in FIG. 4, a middle portion 286 of supply conduit 280 between inlet and outlet 282, 284 of supply conduit 280 may be positioned above inlet and outlet 282, 284 of supply conduit 280 along the vertical direction V. In addition, top wall 266 of reservoir 260 may face and be positioned at top panel 140. Thus, supply conduit 280 may extend through top panel 140 such that middle portion 286 of supply conduit 280 between reservoir 260 and Venturi pump 270 is positioned above top panel 140 along the vertical direction V. In particular, middle portion 286 of supply conduit 280 may be positioned above top panel 140 along the vertical direction V and be disposed within control panel 110. In such a manner, supply conduit 280 may extend between reservoir 260 and Venturi pump 270.

Figure 5:
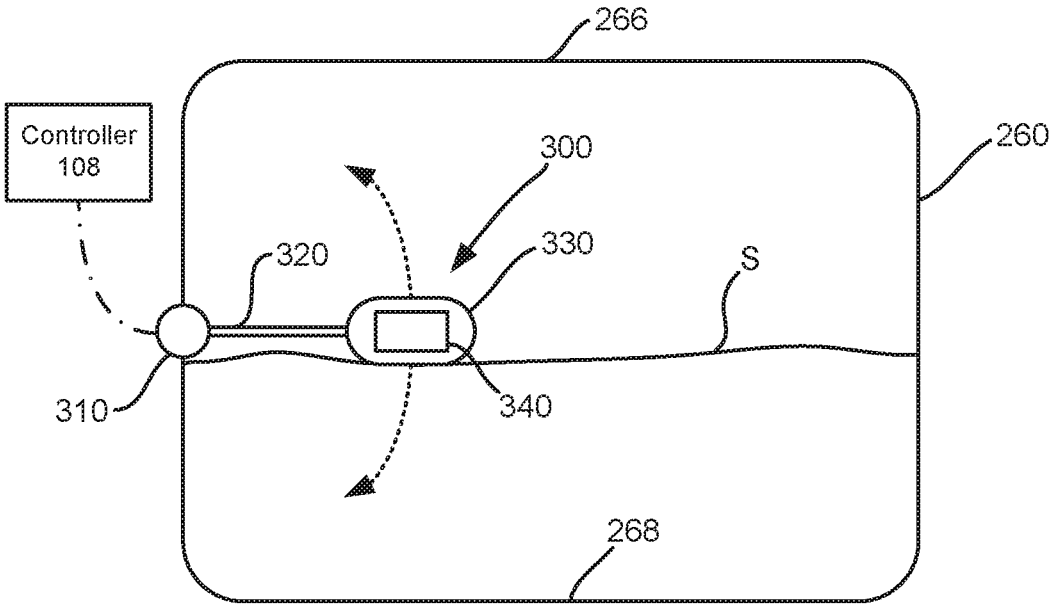
FIGS. 5 and 6 are schematic views of the reservoir and a level sensor of the example washing machine appliance of FIG. 1.
Figure 6:
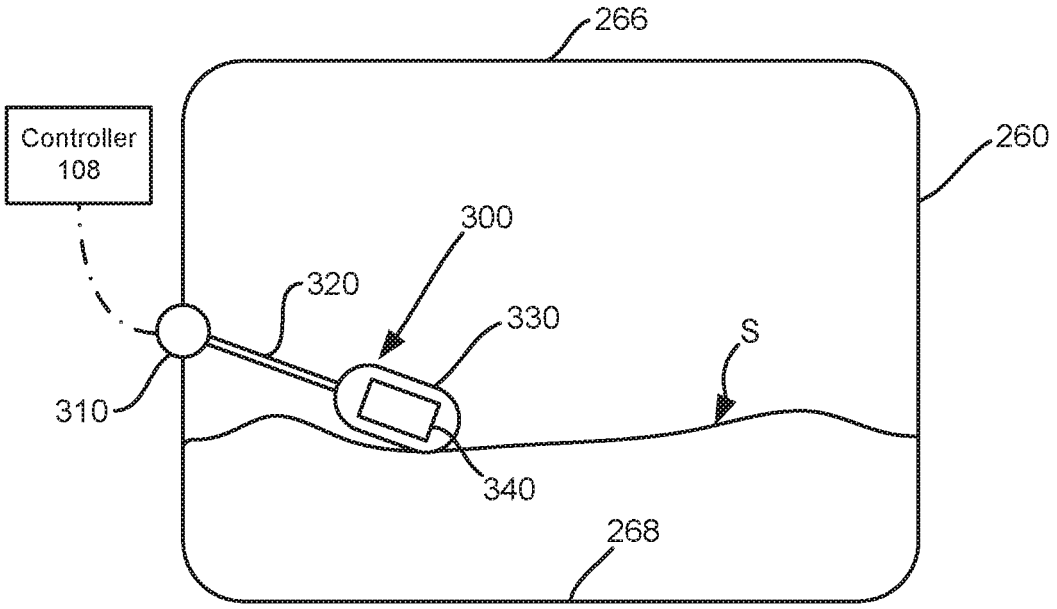

Turning to FIGS. 5 and 6, washing machine appliance 100 also includes a level sensor 300. Level sensor 300 is positioned within reservoir 260. Level sensor 300 may include a tether 320, a float body 330 and a circuit board 340. Tether 320 is mounted within reservoir 260, e.g., such that tether 320 is movable relative to reservoir 260. As an example, tether 320 may be an arm that is rotatably mounted to a side wall of reservoir 260, such as planar sidewall 262 or arcuate sidewall 264 of reservoir 260, with a hinge 310. In particular, a proximal end portion of tether 320 may be rotatably mounted to the side wall of reservoir 260 with hinge 310. Hinge 310 may be spaced from bottom wall 268 of reservoir 260. In alternative example embodiments, tether 320 may be a cord, cable, etc. that is not rigid, and level sensor 300 does not include hinge 310. In such example embodiments, proximal end portion of tether 320 may be attached to the side wall of reservoir 260, e.g., above bottom wall 268 of reservoir 260.

Float body 330 is positioned at a distal end portion of tether 320, and is less dense than the fluid additive within reservoir 260. Thus, e.g., float body 330 may float on a surface S of fluid additive within reservoir 260 as shown in FIGS. 5 and 6. In particular, reservoir 260 is filled and/or as fluid additive is dispensed from reservoir 260 during operation of washing machine appliance 100, a volume of fluid additive within reservoir 260 changes and the surface S of fluid additive within reservoir 260 moved vertically. In other words, a fill level of fluid additive within reservoir 260 changes. Float body 330 may move on tether 320 to track the fill level of fluid additive within reservoir 260, as discussed in greater detail below. By movably mounting float body 330 on tether 320, level sensor 300 may advantageously be less susceptible to the binding caused by fluid additive with known float sensors that ride on tracks.

Circuit board 340 is positioned within float body 330. Thus, e.g., circuit board 340 may move with float body 330 as the surface S of fluid additive within reservoir 260 moves, e.g., vertically upward or downward. Circuit board 340 includes one or more of an accelerometer chip and a gyroscope chip. Thus, e.g., circuit board 340 may include an accelerometer chip, a gyroscope chip or both. As an example, circuit board 340 may include a microelectromechanical systems (MEMS) gyroscope, and the MEMS gyroscope may be configured to measure movement of float body 330 on tether 320. As another example, circuit board 340 may include a plurality of MEMS accelerometers. Each of the MEMS accelerometers may be configured to measure vibration along a respective one of three mutually perpendicular axes while wash basket 120 rotates within tub 118. Thus, e.g., circuit board 340 may include three MEMS accelerometers, and each of the three MEMS accelerometers may be configured to measure vibration along a respective one of an X axis, a Y axis and a Z axis that are mutually perpendicular. It will be understood that circuit board 340 may include both the MEMS gyroscope and the MEMS accelerometers in certain example embodiments.

Utilizing level sensor 300, controller 108 may measure the fill level of fluid additive within reservoir 260 and/or detect an out of balance condition for washing machine appliance 100. For example, controller 108 may receive a signal from level sensor 300 (from circuit board 340) that corresponds to the level or height of the surface S of fluid additive within reservoir 260. In particular, when reservoir 260 is empty a rotational and/or vertical position of the MEMS gyroscope may be set. As reservoir 260 is filled within fluid additive and the surface S of fluid additive within reservoir 260 rises, the MEMS gyroscope may track the change in rotational and/or vertical position of float body 330 and circuit board 340. Based upon the change in rotational and/or vertical position measured by the MEMS gyroscope, controller 108 may calculate the height of the surface S of fluid additive within reservoir 260. In such a manner, controller 108 may measure the fill level of fluid additive within reservoir 260.

In addition to measuring the fill level of fluid additive within reservoir 260, level sensor 300 may also detect an out of balance condition for washing machine appliance 100. For example, controller 108 may receive a signal from level sensor 300 (from circuit board 340) that corresponds to a magnitude of vibrations along one or more axes. In particular, the MEMS accelerometers in circuit board 340 may measure vibrations during operation of washing machine appliance 100, e.g., while wash basket 120 rotates within tub 118. When washing machine appliance 100 is out of balance, the fluid additive within reservoir 260 oscillates to the magnitude of the out of balance. Thus, when the MEMS accelerometers measure vibrations that exceed a threshold vibration, controller 108 may determine that washing machine appliance 100 is out of balance. In particular, the MEMS accelerometers may measure vibrations along three mutually perpendicular axes to assist with detecting when washing machine appliance 100 is out of balance. Controller 108 may take adjust operation of washing machine appliance 100, such as changing a rotational speed of wash basket 120, to remediate the out of balance condition. By detecting an out of balance condition for washing machine appliance 100 with level sensor 300, washing machine appliance 100 can avoid detect out of balance conditions without an additional sensor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a tub positioned within the cabinet;

a basket positioned within the tub, the basket rotatable within the tub;

a bulk dispense tank positioned within the cabinet, the bulk dispense tank configured such that fluid additive within the bulk dispense tank is flowable to the tub, the bulk dispense tank sized to hold a volume of the fluid additive for a plurality of wash cycles;

a level sensor positioned within the bulk dispense tank, the level sensor comprising a tether, a float body and a circuit board, the tether mounted within the bulk dispense tank such that a distal end portion of the tether is moveable relative to the bulk dispense tank, the float body positioned at the distal end portion of the tether, the circuit board positioned within the float body and having both an accelerometer and a gyroscope; and a controller in operative communication with the circuit board of the level sensor, the controller configured for determining a level of the fluid additive within the bulk dispense tank with the gyroscope by tracking a change in position of the float body with the gyroscope, the controller further configured for detecting an out of balance condition of the washing machine appliance with the accelerometer by measuring vibrations of the float body with the accelerometer.

2. The washing machine appliance of claim 1, wherein the gyroscope of the circuit board comprises a microelectromechanical systems (MEMS) gyroscope configured to measure movement of the float body on the tether, the controller configured to determine the level of the fluid additive within the bulk dispense tank based upon an output of the MEMS gyroscope.

3. The washing machine appliance of claim 1, wherein the controller is further configured for receiving a vibration measurement from the level sensor while the basket rotates within the tub, the controller configured to detect the out of balance condition of the washing machine appliance based upon the vibration measurement from the level sensor.

4. (Withdrawn, Previously Presented) The washing machine appliance of claim 3, wherein the accelerometer of the circuit board comprises a plurality of microelectromechanical systems (MEMS) accelerometers, each of the plurality of MEMS accelerometers configured to measure vibration on a respective one of three mutually perpendicular axes while the basket rotates within the tub.

5. The washing machine appliance of claim 1, wherein the tether is attached to a side wall of the bulk dispense tank.

6. The washing machine appliance of claim 1, wherein the gyroscope of the circuit board comprises a microelectromechanical systems (MEMS) gyroscope configured to measure movement of the float body on the tether.

7. The washing machine appliance of claim 6, wherein the accelerometer of the circuit board further comprises a plurality of MEMS accelerometers, each of the plurality of MEMS accelerometers configured to measure vibration along a respective one of three mutually perpendicular axes while the basket rotates within the tub.

* * * * *